United States Patent [19]

Motzkus et al.

[11] 4,368,055

[45] Jan. 11, 1983

[54] SOLVENT BLEED-FAST, DEEP-SHADE DISPERSE DYED TEXTILE MATERIAL

[75] Inventors: Gert Motzkus; Kurt Fohn, both of Charlotte, N.C.

[73] Assignee: BASF Wyandotte Corporation, Wyandotte, Mich.

[21] Appl. No.: 307,774

[22] Filed: Oct. 2, 1981

[51] Int. Cl.[3] ..... C09B 67/00; D06P 3/82

[52] U.S. Cl. ..... 8/662; 8/531; 8/532; 8/606; 8/115.5; 8/922; 8/924

[58] Field of Search ..... 8/662, 531, 532, 606, 8/115.5

[56] References Cited

U.S. PATENT DOCUMENTS

| | | | |
|---|---|---|---|
| 3,135,577 | 6/1964 | Watson et al. | 8/115.5 |
| 3,993,438 | 11/1976 | Fishwick et al. | 8/532 |
| 4,147,510 | 4/1979 | Bostock et al. | 8/532 |
| 4,153,413 | 5/1979 | Bostock et al. | 8/532 |

FOREIGN PATENT DOCUMENTS

| | | |
|---|---|---|
| 2641608 | 3/1978 | Fed. Rep. of Germany . |
| 1589020 | 5/1981 | United Kingdom . |

*Primary Examiner*—A. Lionel Clingman

*Attorney, Agent, or Firm*—Bernhard R. Swick; Andrew E. Pierce

[57] ABSTRACT

Hydrophobic synthetic fabrics dyed in deep shades utilizing disperse dyes can be improved in solvent bleeding properties by subjecting the dyed fabric to treatment comprising exposure to an aqueous alkaline solution at elevated temperatures prior to the usual heat setting of the dyed fabric. The process is particularly useful for polyester fabrics derived from aromatic polyesters.

13 Claims, No Drawings

SOLVENT BLEED-FAST, DEEP-SHADE DISPERSE DYED TEXTILE MATERIAL

BACKGROUND OF THE INVENTION

1. Field of the Invention

This invention relates to the dyeing with disperse dyes of synthetic hydrophobic textile materials to obtain deep shades.

2. Description of the Prior Art

Bostock et al. disclose in U.S. Pat. Nos. 4,153,413 and 4,147,510 the dyeing of polyester or mixed polyester and cellulosic blends utilizing a disperse dyestuff or mixture of a disperse and reactive dyestuff to obtain improved fastness properties. Certain disperse azo dyestuffs free from carboxylic acid and sulfonic acid groups are utilized. The process includes fixing the dyed textile material at elevated temperatures and then subjecting the dyed textile material to an aqueous alkaline treatment at a pH above 8 and at a temperature between 50° and 85° C. The processes of Bostock et al are said to provide excellent fastness to wet treatments, however, there is no indication that the wet treatments contemplated include exposure to organic solvents.

Fishwick et al. in U.S. Pat. No. 3,993,438 disclose the dyeing of mixed polyester and cellulosic blended textile materials using mixtures of disperse and reactive dyestuffs. The process steps are similar to those disclosed in the Bostock et al references cited above. Excellent fastness to wet treatments is said to characterize the dyed textile materials produced by the process of Fishwick et al.

It is known to color synthetic hydrophobic textile materials, particularly aromatic polyester materials with disperse dyestuffs utilizing an aqueous dispersion thereof which is applied to the textile material by an exhaustion dyeing, padding, or printing process. The dyestuff is thereafter fixed by a subsequent heat treatment of the dyed textile material. In order that the resulting colored textile material will have the maximum fastness properties, it is usually necessary that any unfixed dyestuff be thereafter removed from the surfaces of the fibers of the textile material. This is usually achieved by the so-called "reduction clear" treatment involving the treatment of the dyed and heat-treated textile material with a warm aqueous alkaline solution of sodium hydrosulfite.

SUMMARY OF THE INVENTION

It has been unexpectedly found that synthetic hydrophobic textile materials, particularly aromatic polyester textile materials can be dyed in deep shades with excellent resistant to solvent bleeding by subjecting the dyed fabric prepared utilizing a disperse dye to treatment with an aqueous solution comprising an alkali metal hydroxide at an elevated temperature prior to heat setting the textile material. In addition to the exhaust method of dyeing in which the textile material is dyed in a single bath comprising a disperse dye, the textile material can be dyed utilizing continuous padding and printing methods of dyeing. The alkali metal hydroxide solution, comprising sodium hydroxide, preferably contains a quaternary ammonium salt and is utilized at a considerably higher concentration than has been used in those methods of the prior art in which a warm aqueous alkaline solution of sodium hydrosulfite is used to remove any unfixed dyestuff subsequent to disperse dyeing and heat setting by exposure to an elevated temperature.

DETAILED DESCRIPTION OF THE INVENTION AND THE PREFERRED EMBODIMENTS

In accordance with the present invention, there is provided a method for the treatment of textile materials, particularly textile webs of synthetic, hydrophilic, previously textured fibers comprising first, a dyeing step, second, a treatment with a hot aqueous alkaline solution, and third, a heat setting step. The process of the invention comprises either dyeing a textile material either in a batch process by an exhaust method of dyeing, or continuously dyeing utilizing a padding method or printing method of dyeing the textile web. The process of the invention departs from conventional dyeing processes mainly in the utilization of a treatment step involving immersing the dyed fabric in a hot aqueous alkaline solution prior to a step involving heat setting of the textile web. It has been found that the use of a more concentrated solution of alkali prior to the heat setting step results in a dyed textile material having improved resistance to solvent bleeding of the dyestuff onto adjacent textile materials in textile materials dyed in deep shades.

The dyestuffs to be used in the present invention are preferably those of the well-known series of water-insoluble disperse dyestuffs defined in the Color Index, for example, monoazo and diazo, anthraquinone, napthoperinone, quinophthalone and methine dyestuffs, including the styryl, azamethine, and azostyryl dyestuffs; metal complex dyestuffs of the azo and formazan series are also suitable. Other suitable types of disperse dyestuffs can be used.

The dyestuffs can be applied to the synthetic hydrophobic textile material either in the form of an aqueous dispersion or in the form of a solution in an organic solvent. Preferably, the synthetic hydrophobic textile materials are treated with a disperse dye in either the exhaust, the padding or the printing method of dyeing in accordance with which the textile fibers are exposed to the dyestuff in a bath containing water or a suitable organic solvent at concentrations in the range of about 0.1 to about 1.5 grams of dye per liter of water or solvent medium. The dye bath temperature is advantageously in the range of about 212° to about 280° F. The time for completion of the dyeing step will vary depending upon the depth of shade desired as well as the concentration of the dyestuff and the temperature utilized in the dye bath.

Of the various methods of applying the dyestuff to the hydrophobic synthetic textile material, it is preferred to use an exhaust method of dyeing in single or multiple baths in which the dyestuff is dispersed in water or a suitable solvent at an elevated temperature of about 212° F. or above. In addition to the disperse dyestuffs, the dye bath, padding liquor or print paste can contain any of the adjuvants which are conventionally employed in such dye baths, liquors, or pastes, for example, cationic, anionic or non-ionic dispersing agents, thickening agents, migration inhibitors, urea, humectants, solubilizing agents, bacteriocides, sequestering agents, wetting agents, emulsifiers, oxidizing agents such as sodium chlorate or sodium m-nitrobenzene sulfonate, fixation accelerators such as diphenyl and derivatives thereof or polyethylene oxide adducts known as carriers or fixation accelerators, or antifoam agents such as organic derivatives of silicone.

The dyebath, padding liquor or print paste can be slightly alkaline or neutral but is preferably acidic. This can be achieved by incorporating therein a small amount up to 20 percent by weight of an acidic agent such as acetic acid. Alternatively, the dye bath, print paste, or padding liquor can contain a substance which, upon heating, liberates an acidic agent such as ammonium sulfate. The apparatus utilized in the exhaust process of dyeing, the padding process, and the printing process is conventional and fully described in the literature.

The hydrophobic textile materials to be treated in accordance with the invention are mainly in the form of fabric or suitable knit wear or carpeting of any description made of fully synthetic hydrophobic fibers, for example, aromatic polyesters, particularly polyethylene terephthalate fibers and polyamides, for example, those polyamides prepared by reacting hexamethylene diamine with sebacic acid or those prepared by copolymerizing hexamethylene diamine, adipic acid, and $\epsilon$-caprolactam. The preferred polyethylene terephthalate fibers are those derived from the reaction of terephthalate acid and ethylene glycol or 1,4-dimethylolcyclohexane. Copolymers of terephthalic acid and isophthalic acid and ethylene glycol are also useful textile materials for use in accordance with the invention.

As a second step in the dyeing process of the invention, coming prior to the heat treatment of the dyed material to heat set the dyed synthetic hydrophobic textile material, there is utilized a solution comprising a hot aqueous alkaline solution having a pH of at least 9.0 and generally having a pH in the range of 10.0 to 13.5, preferably a pH of 10 to 11.5. The temperature at which the aqueous alkaline solution is used is preferably in the range of 150° F. to 200° F., the higher temperatures generally being used at the lower pH's and the lower temperature being used at the higher pH's. The time of treatment will vary with the depth of shade which has been applied to the synthetic hydrophobic textile material as well as the type of dyeing equipment being utilized in the process. The time of treatment in a hot aqueous alkaline solution is generally in the range of 30 seconds to 60 minutes, preferably about 5 minutes to about 30 minutes. The alkaline solution comprises an alkali metal hydroxide and preferably contains a quaternary ammonium compound. If desired, the hot aqueous alkaline solution can also contain a small amount of a synthetic detergent, for example, about 0.1 percent to about 2 percent thereof by weight.

The hot aqueous alkaline solution utilized in the process of the invention is prepared utilizing an alkali metal hydroxide, preferably sodium hydroxide. Alkaline agents such as ammonia or ammonium salts or organic amines such as triethanolamine or alkali metal carbonates have been found to be ineffective for use in the process of the invention. The concentration of alkali metal hydroxide utilized in the hot aqueous solution is generally about 3 grams per liter to about 10 grams per liter, preferably about 3 to about 8 grams per liter, and where the aqueous alkaline solution also contains a quaternary ammonium compound, it is present generally at a concentration of about 1 gram per liter to about 10 grams per liter, preferably about 3 to about 8 grams per liter.

Although the process of the invention is described in the Examples with reference to the use of a single disperse dyestuff, it will be understood that various disperse dyestuffs as well as mixtures of said disperse dyestuffs can be used in order to obtain a wide variety of shades. In addition, two or more disperse dyestuffs can be applied in separate steps in any order, but preferably the disperse dyestuffs are applied in admixture. As an alternative process for dyeing to the exhaust dyeing process, the disperse dyestuff can be continuously applied to the synthetic hydrophobic textile material by padding on said textile material an aqueous dispersion of a disperse dyestuff. The aqueous dispersion of the disperse dyestuff can be prepared utilizing dispersing agents, for example, non-ionic dispersing agents, cationic dispersing agents, and anionic dispersing agents or a compatible mixture of two or more of such dispersing agents. If desired, the padding liquor can also contain conventional additives, for example, additional dispersing agents, thickeners, migration inhibitors or urea.

In a second alternative method of application of the disperse dyestuff to the synthetic hydrophobic textile material, a thickened printing paste containing the disperse dyestuff in dispersed form can be applied to the surface of the textile material by any of the methods conventionally used for applying printing paste to synthetic textile materials, for example, by block, screen, or roller printing. Suitable thickening agents which can be used in the printing paste include tragacanth, gum arabic, alginates, for example, sodium or ammonium alginates, oil-in-water or or water-in-oil emulsions, or thickening agents of synthetic origin based upon ethylene/maleic anhydride copolymers or polyacrylic acids. The printing paste can also contain conventional additives such as urea, sodium nitrobenzene sulfonate, diamides, acids or alkalies for their usual purposes in printing pastes containing disperse dyestuffs.

As a third step in the dyeing process of the invention, there is usually included a heat-setting step. This heat-setting step is utilized to heat set the synthetic hydrophobic textile material. The heat treatment can, for example, comprise treatment with super-heated steam or by steam either at atmospheric pressure or under additional pressure, or a baking treatment in hot air all at temperatures of about 275° F. to about 375° F. Additionally, the heat-setting step can take place by passing the dyed textile material over a heated surface, for example, over calender rolls. The heat-setting step is necessary to prevent shrinkage of the textile material, but it is this step which destroys the fastness to solvent bleeding of the textile material if it is not previously treated with a hot aqueous alkaline solution as described herein.

TEST METHODS

In order to evaluate the solvent bleeding fastness of a dyed synthetic hydrophobic textile material prepared in accordance with the process of the invention, samples of dyed fabric are sewn to 80×80 white cotton muslin fabric cut to the same dimensions as the dyed sample of fabric using diagonal zig-zag stitches. Thereafter, the sewn specimens are placed face up on a blotter with the cotton fabric adjacent to the blotter. Perchloroethylene is applied to the sewn specimens with a swab made of a rolled, undyed dacron/wool fabric inserted in a small, round metal pipe or tube. The dyed side of the sample is rubbed across its width with the swab 10 times using firm strokes. The sample is then placed upon a screen in order to air-dry the sample over a period of 5 to 15 minutes. The solvent bleeding tendency of the dyed specimen is determined by the degree of bleeding of the dye onto the cotton fabric to which it is sewn.

The following examples illustrate the various aspects of the invention but are not intended to limit its scope. Where not otherwise specified throughout this specification and claims, temperatures are given in degrees Centigrade, and parts, percentages and proportions are by weight.

EXAMPLE 1

A 100 percent texturized polyethylene terephthalate knit fabric was dyed with Foron Navy S-2GL Disperse Blue 79, as further identified in the Color Index. Using a dye/liquor ratio of 1/20, the texturized polyester knit fabric was dyed by immersing the fabric in the dye bath made up as indicated above for a period of one hour at a temperature of 265° F. A navy blue dyed polyester fabric was obtained which was next subjected to a hot alkaline treatment consisting of a mixture of sodium hydroxide at a concentration of 5 grams per liter in admixture with a cationic quaternary ammonium salt sold under the trademark BASACRYL Salt NB-KU at a concentration of 5 grams per liter. The fabric was treated in the sodium hydroxide solution at a temperature of 190° F. for a period of 15 minutes. The fabric was thereafter dried and heat-set for a period of 45 seconds at a temperature of 360° F. In comparison with control Example 2, the dyed fabric showed improved bleeding fastness over the control sample which is representative of a prior art exhaust dyeing process for use with a polyester fabric.

EXAMPLE 2

(Control—forming no part of this invention)

The process of Example 1 is repeated except that instead of a hot aqueous alkaline treatment subsequent to dyeing the polyester fabric, there was utilized a conventional "reduction clear" treatment consisting of the use of warm alkaline hydrosulfite. The treating solution contained 1 gram per liter of sodium hydroxide, 1 gram per liter of hydrosulfite, and 1 gram per liter of an ethylene oxide based dispersing agent. The dyed polyester fabric was treated for a period of 10 minutes at a temperature of 140° F. The deep navy blue dyed polyester fabric, when compared against the dyed fabric of Example 1, is inferior in solvent bleeding fastness.

While this invention has been described with reference to certain specific embodiments, it will be recognized by those skilled in the art that many variations are possible without departing from the scope and spirit of the invention and it will be understood that it is intended to cover all changes and modifications of the invention disclosed herein for the purposes of illustration which do not constitute departures from the spirit and scope of the invention.

The embodiments of the invention in which an exclusive privilege or property is claimed are defined as follows:

1. An improved process for the aqueous disperse dyeing or printing in deep shades of a synthetic hydrophobic textile material impregnated with a solution or dispersion comprising a disperse dyestuff to produce a colored textile material, said process comprising:

(a) aftertreating said colored textile material in an aqueous alkaline solution comprising an alkali metal hydroxide bath at a pH of at least 9.0 and at a temperature of about 150°F. to about 200°F. and at a time of about 30 seconds to about 60 minutes, and thereafter (b) heat setting said colored textile material by a heat treatment at an elevated temperature.

2. The process of claim 1 wherein said synthetic hydrophobic textile material comprises an aromatic polyester of a polyamide which is continuously dyed in a deep shade by padding or printing with an aqueous pad liquor or print paste comprising a disperse dyestuff.

3. The process of claim 1 wherein said aromatic polyester is dyed by an exhaust method in a single bath comprising a disperse dye.

4. The process of claims 2 or 3 wherein said alkali metal hydroxide is present in said solution at a concentration of about 3 to about 10 grams per liter together with a quaternary ammonium salt, present in said solution at a concentration of about 1 to about 10 grams per liter.

5. The process of claim 4 wherein said textile material is polyethylene terephthalate, said alkali metal hydroxide is sodium hydroxide and wherein said textile material is heat set by heating at a temperature of about 275° F. to about 375° F.

6. In a process for the aqueous dispersion dyeing in deep shades of a synthetic hydrophobic textile material, the improvement comprising dyeing said textile material by a dyeing method consisting of an exhaust method or a padding method to produce a colored textile material, next subjecting said colored textile material to a treatment in a hot, aqueous, alkaline solution comprising an alkali metal hydroxide at a pH of at least 9.0 and a temperature of about 150° F. to about 200° F. for about 30 seconds to about 60 minutes.

7. The process of claim 6 wherein said synthetic hydrophobic textile material comprises an aromatic polyester or a polyamide and said dyeing method is an exhaust method utilizing a single bath comprising a disperse dye.

8. The process of claim 7 wherein said aromatic polyester is polyethylene terephthalate and said alkaline solution contains a quaternary ammonium salt.

9. The process of claim 8 wherein said alkali metal hydroxide is sodium hydroxide which is present at a concentration of about 3 to about 10 grams per liter.

10. The process of claim 9 wherein said quaternary ammonium salt is present at a concentration of about 1 to about 10 grams per liter and said colored textile material is heat set by heating at a temperature of about 275° F. to about 375° F.

11. A deep dyed synthetic hydrophobic textile material resistant to solvent bleeding prepared in accordance with the process of claims 1 or 6.

12. The composition of claim 11 wherein said deep dyed synthetic hydrophobic textile material comprises an aromatic polyester, and wherein said aromatic polyester is dyed utilizing an exhaust method, a padding, or printing method.

13. The composition of claim 12 wherein said textile material comprises polyethylene terephthlate.

* * * * *